US006816128B1

(12) United States Patent
Jennings

(10) Patent No.: US 6,816,128 B1
(45) Date of Patent: Nov. 9, 2004

(54) PRESSURIZED ANTENNA FOR ELECTRONIC WARFARE SENSORS AND JAMMING EQUIPMENT

(75) Inventor: William C. Jennings, Iowa City, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 10/603,543

(22) Filed: Jun. 25, 2003

(51) Int. Cl.[7] ..... H01Q 15/20
(52) U.S. Cl. ..... 343/915; 343/700 MS
(58) Field of Search ..... 343/915, 700 MS, 343/895; 102/200, 202, 202.5, 202.14, 206

(56) References Cited

U.S. PATENT DOCUMENTS

| | | | | | |
|---|---|---|---|---|---|
| 4,364,053 | A | * | 12/1982 | Hotine | 343/915 |
| 4,786,915 | A | * | 11/1988 | Cartwright et al. | 343/909 |
| 5,889,498 | A | * | 3/1999 | Lange et al. | 343/840 |
| 5,920,294 | A | * | 7/1999 | Allen | 343/912 |
| 5,990,851 | A | * | 11/1999 | Henderson et al. | 343/915 |
| 5,999,143 | A | * | 12/1999 | Glynn | 343/840 |
| 6,219,009 | B1 | * | 4/2001 | Shipley et al. | 343/915 |
| 6,373,449 | B1 | * | 4/2002 | Bokulic et al. | 343/915 |
| 6,417,818 | B2 | * | 7/2002 | Shipley et al. | 343/915 |
| 6,545,647 | B1 | * | 4/2003 | Sievenpiper et al. | 343/795 |
| 6,606,057 | B2 | * | 8/2003 | Chiang et al. | 342/374 |
| 6,690,336 | B1 | * | 2/2004 | Leisten et al. | 343/895 |
| 6,759,990 | B2 | * | 7/2004 | Rossman | 343/700 MS |

OTHER PUBLICATIONS

Lundgren et al, "A Study of a Printed Log–Periodic Antenna", The Second Annual Symposium on Computer Science and Electrical Engineering, Luleå University of Technology, Sweden, May 2001.

Thomas et al, "Pressurized Antennas for Spaced Radars", American Institute of Aeronautics and Astronautics pub. 80–1928. 1980, pp. 65–71.

"Rogers RT/duroid Material Provides Flexible Substrate in New Conical Antenna", Rogers Corporation Technical Article RT 5.3.1. 1998.

(List continued on next page.)

*Primary Examiner*—Don Wong
*Assistant Examiner*—Huedung X Cao
(74) *Attorney, Agent, or Firm*—Nathan O. Jensen; Kyle Eppele

(57) ABSTRACT

A terrestrially deployed flexible antenna is disclosed. The antenna includes a planar, flexible dielectric material having a first side and a second side. A flexible conductive ground plane is secured to the first side of the dielectric material. At least one flexible, planar conductive element is secured to the second side of the flexible dielectric material. The flexible dielectric material is bonded to form a collapsible enclosed volume with the ground plane forming an inner surface of the enclosed volume. A propellant is disposed within tie enclosed volume. The propellant releases a predetermined volume of gas when ignited. An igniter ignites the propellant to release the predetermined volume of gas, to thereby temporarily expand the enclosed volume to a predetermined shape such that the ground plane, the dielectric material, and the at least one conductive element cooperate to form a resonant antenna circuit.

18 Claims, 3 Drawing Sheets

OTHER PUBLICATIONS

Leisten et al, "Simulating the Dielectric–loaded Quadrifilar Helix Antenna using an Brute–Force TLM Approach", Proc. 15th ACES Conference, Mar. 1999, vol. 1, p. 479–.

Leisten et al, "Performance of a Miniature Dielectrically Loaded Volute Antenna", Institute of Navigation Conference, Palm Springs, California, Sep. 12–15 1995.

Leisten et al, "A Broad–Band Miniature Dielectric–Loaded Personal Telephone Antenna—With Low SAR", Institution of Electrical Engineers (UK), pp. 10/1–10/6, 1999.

"Space Inflatables on the Rise", Jet Propulsion Laboratory News Release, Aug. 9, 2000.

"Gossamer Spacecraft", Engineering Newsline, University of Arkansas [online], Mar. 24, 1999 [retrieved on Jun. 24, 2003]. Retrieved from the Internet: <URL:http://www.engr.uark.edu/News/PR_GOSSAMER_SPACE.html>.

Moore, "The Gossamer Spacecraft Initiative" [online], Mar. 24, 1999 [retrieved on Jun. 24, 2003]. Retrieved from the Internet: <URL:http://origins.jpl.nasa.gov/meetings/ulsoc/papers/moore_c.pdf>.

"Gossamer Spacecraft Exploratory Research and Technology Program NRA 00–OSS–06", Abstracts for the Gossamer Spacecraft Exploratory Research and Technology, [online], Apr. 1, 2001 [retrieved on Jun. 24, 2003]. Retrieved from the Internet: <URL: http://research.hq.nasa.gov/code_s/nra/current/NRA–00–OSS–06/winners.html>.

"Partners in the Inflast project", section 2.5 (CASA) [online], last updated Jul. 17, 1999 [retrieved on Jun. 24, 2003]. Retrieved from the Internet: <URL:http://www.isd.uni–stuttgart.de/arbeitsgruppen/inflast/inflast.html>.

Braband, "The First 50 Years: A History of Collins Radio Company and the Collins Divisons of Rockwell International", Rockell International, Cedar Rapids, Iowa, 1983, pp. 127–129.

* cited by examiner

PRESSURIZED ANTENNA FOR ELECTRONIC WARFARE SENSORS AND JAMMING EQUIPMENT

FIELD OF THE INVENTION

The invention relates to communication devices and methods of constructing communication devices. More particularly, the invention relates to temporarily pressurized, terrestrial-based antennas and methods of constructing the same.

BACKGROUND OF THE INVENTION

The field of electronic attack and electronic warfare (EA/EW) is rapidly developing as an important component in modem warfare operations. It may be imperative to jam or inderdict the electronic communications signals of an enemy. Sensing and eavesdropping on an enemy's communications may also be a high priority in a particular operation. Various strategies have been devised to conduct such EA/EW operations. Such strategies may involve airborne or marine-based sensing and jamming equipment.

One drawback to airborne or marine-based eavesdropping strategies is that an enemy may reasonably come to expect such strategies and may modify its behavior to lessen the value of information so obtained. In such instances it may be advantageous to place EA/EW systems in places that will not be anticipated by an enemy.

One solution may be to deploy a low-power EA/EW system, close to an electronic target of interest, in a manner that does not attract the enemy's attention. A challenge to designing covertly installed low-power EA/EW systems is that a premium is placed on high performance, mission length, low cost, small volume, light weight, and ruggedness. A key component affecting these parameters is antenna design. To the equipment designer, antennas represent a challenge because antennas typically use valuable volume needed for electronics and power sources. Antenna dielectric substrate materials add weight and antenna radiator elements add bulk and mechanical inflexibilities to the design. For trooper deployed equipment, the packing and setup of the antenna can influence deployment time, effectiveness and increased risk to the mission. For air-platform, munition and missile deployment, the mechanical fragility of antennas is an important consideration. Remotely deployed and/or activated RF surveillance and jamming/access denial equipment require efficiently packaged, lightweight and low-cost antennas, particularly for expendable equipment.

It is therefore an object of the invention to provide an antenna that may be used in electronic warfare operations.

It is another object of the invention to provide an antenna that may be easily and inexpensively manufactured.

It is another object of the invention to provide an antenna that is self-erecting.

It is still another object of the invention to provide an antenna that, in an non-erected state, is low-volume and compact.

It is still another object of the invention to provide an antenna that is lightweight and portable.

It is yet another object of the invention to provide an antenna that does not sacrifice radiation efficiency or electrical gain at the expense of its design.

It is yet another object of the invention to provide an antenna that is rugged and can survive extreme acceleration and vibration.

It is yet another object of the invention to provide an antenna that facilitates the design of EA/EW equipment.

It is another object of the invention to provide an antenna that may be rapidly deployed to reduce mission/personnel risk, and that may be matched to mission objectives of disposability and short-duty time.

It is yet another object of the invention to provide an antenna that is performs equivalent to standard mechanical antenna designs.

A feature of the invention is a terrestrial, temporarily inflatable antenna.

An advantage of the invention is that the antenna may be configured to be used in many different environments.

Another advantage is that the invented antenna can be configured into any standard antenna type such as volute, spiral, log periodic, discone, or other antenna types.

SUMMARY OF THE INVENTION

The invention provides a terrestrially deployed flexible antenna. The antenna includes a planar, flexible dielectric material having a first side and a second side. A flexible conductive ground plane is secured to the first side of the dielectric material. At least one flexible, planar conductive element is secured to the second side of the flexible dielectric material. The flexible dielectric material is bonded to form a collapsible enclosed volume with the ground plane forming an inner surface of the enclosed volume. A propellant is disposed within the enclosed volume. The propellant releases a predetermined volume of gas when ignited. An igniter ignites the propellant to release the predetermined volume of gas, to thereby temporarily expand the enclosed volume to a predetermined shape such that the ground plane, the dielectric material, and the at least one conductive element cooperate to form a resonant antenna circuit.

The invention also provides a remote communications device. The device includes a transceiver and an expandable, terrestrially-based antenna operationally connected to the transceiver. The antenna includes a sheet of flexible dielectric material having a first side and a second side, a flexible conductive ground plane secured to the first side of the flexible dielectric material, and at least one flexible, planar conductive element secured to the second side of the flexible dielectric material. The flexible dielectric material is shaped and bonded to form a collapsible enclosed volume with the ground plane forming an inner surface of the enclosed volume. A propellant is enclosed within the enclosed volume. The propellant is configured to release a gas when ignited. An igniter is configured to ignite the propellant and temporarily expand the enclosed volume to a predetermined shape such that the ground plane, the dielectric material, and the at least one conductive element cooperate to form a resonant electrical circuit.

The invention further provides a method of establishing electronic communication in an electronic warfare environment. According to the method, an electronic communications apparatus is connected to a temporarily expandable terrestrial antenna. The antenna includes a substantially enclosed volume with one or more antenna elements secured thereon, and a propellant disposed therein. The propellant is configured to release a gas when ignited. The propellant is ignited and releases gas in the substantially enclosed volume. The substantially enclosed volume is temporarily expanded to assume a predetermined shape. The antenna elements are connected to the electronic communications apparatus.

Other features and advantages of embodiments of the present invention will become apparent to those skilled in the art upon review of the following drawings, the detailed description, and the appended claims.

DETAILED DESCRIPTION OF THE DRAWINGS

Figure 1:
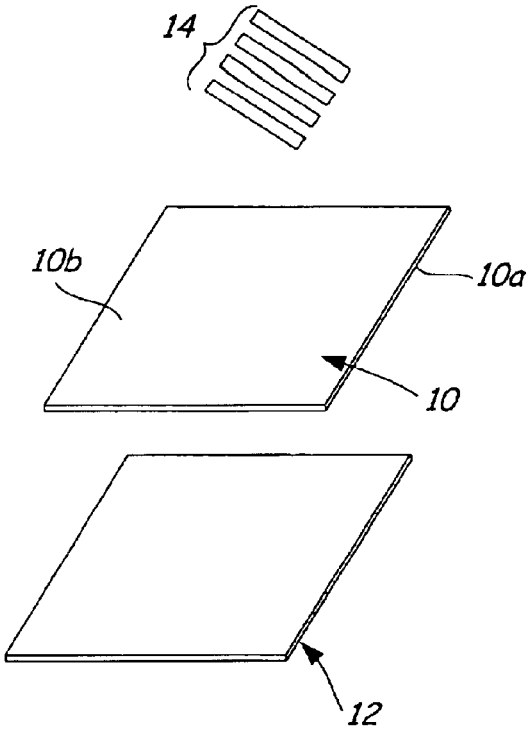
FIG. 1 is an exploded view showing manufacturing steps according to one embodiment of the invention.
Figure 2:
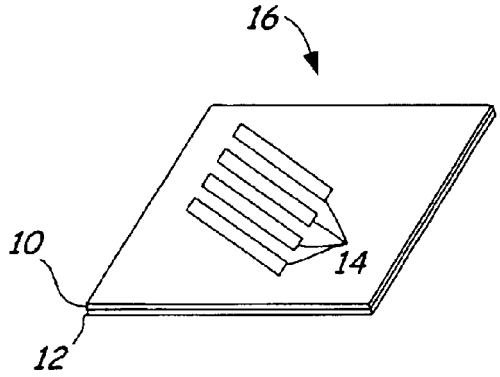
FIG. 2 is a perspective view showing another manufacturing step.

A method of manufacturing an embodiment of the invention is depicted in FIGS. 1–5. As shown in FIG. 1, a sheet of envelope material 10 is provided. Envelope material 10 is made of a flexible material such as TEFLON, KAPTON, or other materials having similar dielectric properties. A sheet of conductive material such as metallic foil 12, is bonded or otherwise attached to a first surface 10*a* of the envelope material. The sheet of metallic foil 12 functions as an antenna ground plane.

One or more antenna elements 14 is bonded or otherwise attached to a second surface 10*b* of the envelope material, thereby forming a combined assembly 16 that includes the envelope material, the ground plane, and the antenna elements. The antenna elements are cut, stamped, or otherwise formed from a flexible, conductive material such as a copper metallic foil. An adhesive resin film, applied to a surface of the antenna elements, is a preferred method of attaching the antenna elements to the envelope material. The shape and number of the antenna elements depend on the type of antenna desired to be built.

Figure 3:
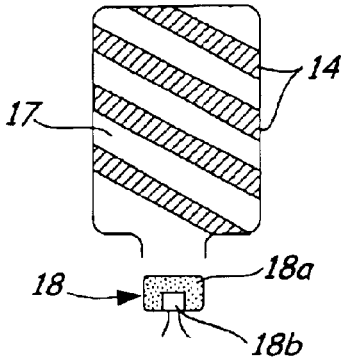
FIG. 3 is a side elevational view showing a further manufacturing step.
Figure 4:
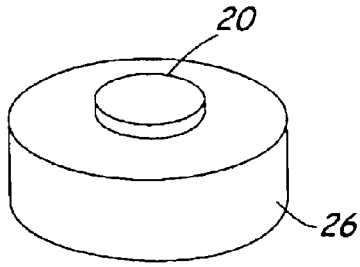
FIG. 4 is a perspective view of the inflatable antenna of the present invention in a collapsed state.

As shown in FIG. 3, the combined assembly is then cut and heat-sealed together to form a substantially enclosed volume 17 having a predetermined three-dimensional shape. The substantially enclosed volume is formed so that antenna elements 14 are disposed upon the outer surface 17*a* thereof. An inflation module 18 is placed at least partially into an opening 17*b* of the substantially enclosed volume. The inflation module includes a propellant 18*a*, which is made of a substance that releases large amounts of gas when detonated, ignited, or otherwise activated. The propellant can be one or more sodium azide pellets, which release large amounts of nitrogen gas in comparison to its pre-ignited volume. The inflation module also includes an igniter 18*b* that responds to an electrical control signal, traveling through leads 18*c*, to ignite or detonate propellant 18*a*. After inflation module 18 is inserted into opening 17*b*, the substantially enclosed volume is evacuated of air and the opening is hermetically sealed such that the substantially enclosed volume is gas-tight. The substantially enclosed volume and the inflation module, which together form an inflatable antenna 20, can then be collapsed or compacted, as shown in FIG. 4, and attached to a communications module 26. The communications module may include circuitry designed for receiving GPS signals from GPS satellites (not shown), sensing or jamming of electronic signals, or sending, receiving, and/or relaying messages.

Figure 5:
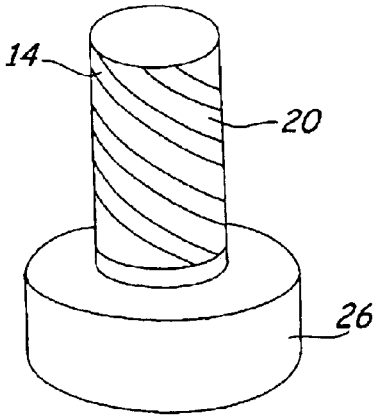
FIG. 5 is a perspective view of the inflatable antenna of the present invention in an inflated state.

When it is desired to activate inflatable antenna 20, an electrical signal is sent through electrical leads 18*c* to igniter 18*b*, which ignites or detonates propellant 18*a*. As the ignited propellant releases gas, the inflatable antenna expands until the antenna assumes a predetermined shape, which in FIG. 5 is shown to be cylindrical. Because envelope material 10 is substantially gas-impermeable, the gas released by the ignited propellant remains inside the substantially enclosed volume and maintains the antenna in the predetermined shape. Antenna elements 14, connected to communications module 26 by appropriate circuitry, can then properly function to send and/or receive signals in the desired frequency ranges.

Although propellant 18*a* has been disclosed as being sodium azide, azide-free propellants may also be used, such as nitroguanidine (NIGU), tri-amino guanidine nitrate, guanidinium azotetrazolate (GZT), 5-amino-tetrazole, or other nitrogen-rich, carbon-poor organic compounds. The propellant is designed to ignite easily and can be modified with various igniting strategies and time delays to obtain various propellant burning rates or pressure/time curves. For example, propellant 18*a* and igniter 18*b* can be selected to inflate antenna 20 in less than one-twenty-fifth of a second, or can be selected to inflate the antenna over several minutes to escape notice of potential observers of the inflating antennas. Also, if it is desired to maintain antenna 20 in an inflated state for a limited time, antenna can be designed to be semi-permeable such that gas produced by ignited propellant escapes from inside the antenna at a controlled rate, and the antenna deflates after a predetermined time. Other inflation/deflation strategies can also be used and are considered to be within the scope of the invention.

As previously disclosed, the envelope material may be formed of Polytetrafluoroethyene (PFTE), known as TEFLON. TEFLON is a fluoropolymer possessing a unique combination of frictional, chemical, thermal, and electrical properties. It has a non-stick nature, is non wetting and self-lubricating. It is unaffected by all known chemicals, except alkali metals and fluorine under certain conditions. It has excellent weather resistance. Of the known, commonly available dielectrics, PFTE has the widest working temperature range and is an excellent insulator. The family of compounds including TEFLON FEP, TEFLON PFA, TEFZEL and KAPTON film fabrications can be heat-sealed, as required by the invention, from 200 gauge (0.002 inches) to 2,000 gauge (0.020 inches).

Another method of manufacturing an inflatable antenna according to the invention is through thermoforming. It has been shown that TEFLON FEP, PFA, and TEFZEL films with thicknesses of 0.002 to 0.090 inches can be formed into three-dimensional shapes using appropriately shaped molds. The ground plane layer and antenna elements are affixed to the TEFLON film layer either before or after thermoforming.

Pressurized inflatable antennas as disclosed herein can be applied to most antenna types, and are most easily manufactured for antennas with geometries of revolution, such as a cone, cylinder, sphere or parabola. The substantially enclosed volume is uniquely shaped for each antenna type due to the unique shape of various antennas, but the process of printing of the antenna elements on the envelope material is essentially the same for any antenna. Among the types of antennas that can be implemented as inflatable terrestrial antennas for Electronic Attack or Electronic Warfare applications are: quadrifilar or volute antennas, Yagi, shotgun Yagi, Helical cylindrical, discone 30 (FIG. 6), corner reflector 50 (FIG. 7), choke ring, conical helix or conical spiral 70 (FIG. 8), log periodic, dipole, top hat loaded monopole, slot and aperture-type antennas, microstrip patch antennas, parabolic dish, and others.

Figure 6:
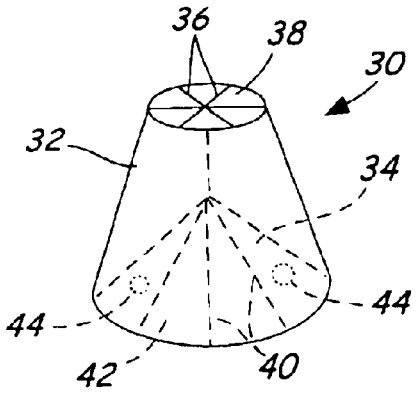
FIG. 6 is a perspective view of another embodiment of the invention.

FIG. 6 depicts a method of implementing the present invention to form a discone antenna 30 using first and second inflatable portions 32, 34. First inflatable element 34 is frusto-conical when inflated and has a plurality of flexible conductive radiator elements 36 disposed upon an upper surface 38. Second inflatable portion 34 is configured to inflate within the first inflatable element and has a concentric conical shape when inflated. Ground plane elements 40 are disposed upon a surface 42 of first inflatable portion. Radiator elements 36 and ground plane elements 40 are connected to obtain the appropriate antenna response. As discone antenna 30 includes two substantially enclosed volumes, it may be advantageous to inflate the antenna by including one or more vents 44 in the second inflatable portion to permit the free passage of gas produced from the ignited propellant therethrough to simultaneously inflate both inflatable portions. Alternatively, the inflatable portions may use separate inflation modules to independently control and maintain each module in an inflated state.

Figure 7:
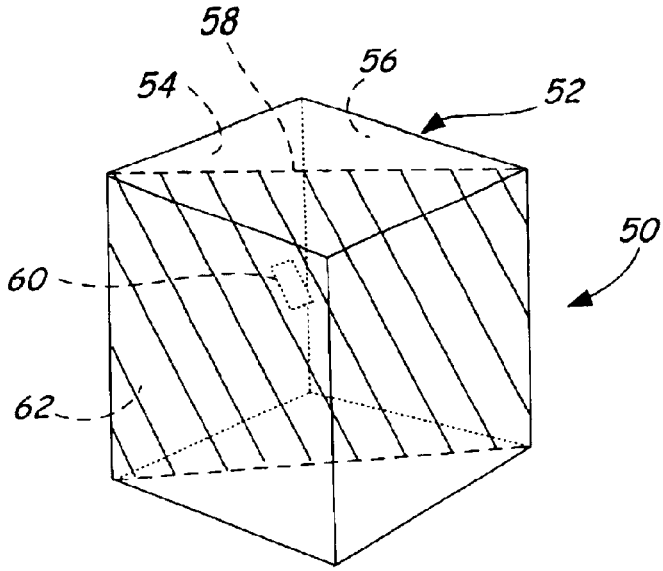
FIG. 7 is a perspective view of another embodiment of the invention.
Figure 8:
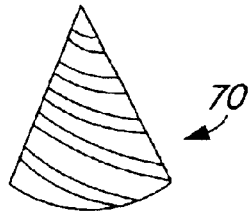
FIG. 8 is a perspective view of yet another embodiment of the invention.

FIG. 7 depicts a method of implementing the present invention to form a corner reflector antenna 50. A substantially enclosed volume 52 is constructed according to methods disclosed herein. Substantially enclosed volume 52 is cubic or otherwise prismatic in shape. Two adjacent inner surfaces 54, 56 of the substantially enclosed volume 52 are covered with a flexible metallic substance, similar to the sheet of conductive material 12, to form a ground plane. The adjacent inner surfaces 54, 56 thereby form the reflecting portion of the antenna. A dielectric sheet 58 is placed diagonally within substantially enclosed volume 52 as shown in FIG. 7. One or more metallized radiating elements 60, constructed of material similar to that of antenna element 14, is placed upon a surface 62 of dielectric sheet 58. In this manner a corner reflector may be formed. As with discone antenna 30, different inflation strategies may be employed to ensure substantially enclosed volume 52 is properly inflated and the various portions of the antenna are properly positioned. Other types of antennas requiring embedded or concentric surfaces, such as a choke ring-type antenna, may be formed using methods similar to those disclosed above with respect to FIGS. 6 and 7.

Figure 9:
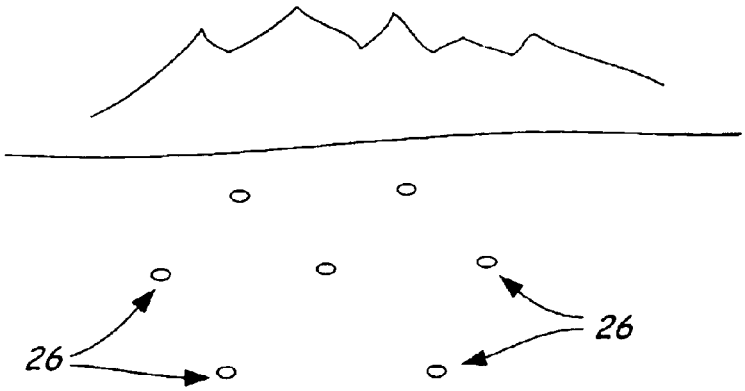
FIG. 9 is a perspective view of a plurality of inflatable antennas in an uninflated state.
Figure 10:
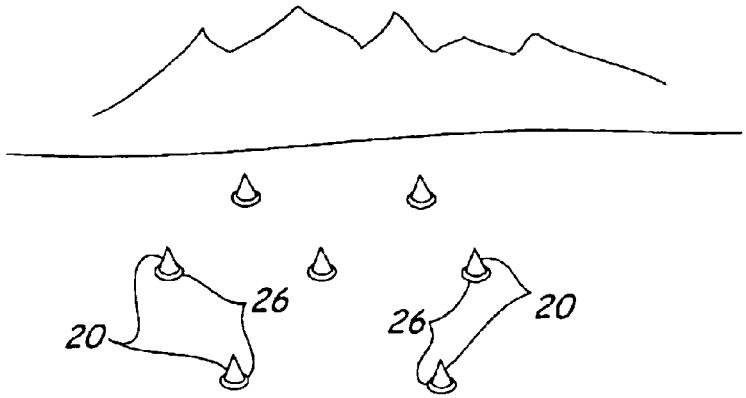
FIG. 10 is a perspective view of a plurality of inflatable antennas in an inflated state.

As shown in FIG. 4, inflatable antenna 20 (in its pre-deployed state) and communications module 26 are designed to be extremely compact, and can therefore be used in situations where its portability and small size are advantageous, such as electronic warfare or electronic attack operations. In one scenario, multiple communications modules can be distributed covertly over an area (FIG. 9) and the inflatable antennas 20 attached thereto remotely activated at a desired time (FIG. 10). The communications modules may act individually or as part of a communications array, depending on the required mission. To reduce attention thereto, the communications modules may be camouflaged to resemble rocks, chunks of ice, debris, or other nondescript items.

Figure 11:
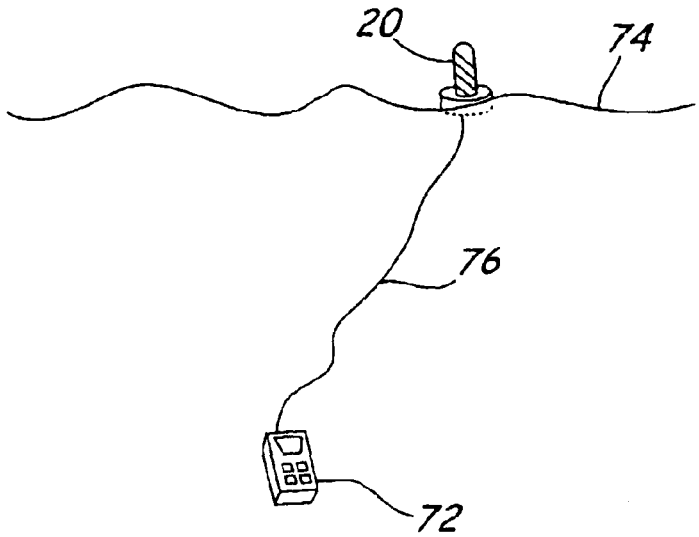
FIG. 11 is a side elevational view of the inflatable antenna according to another embodiment of the invention.
Figure 12:
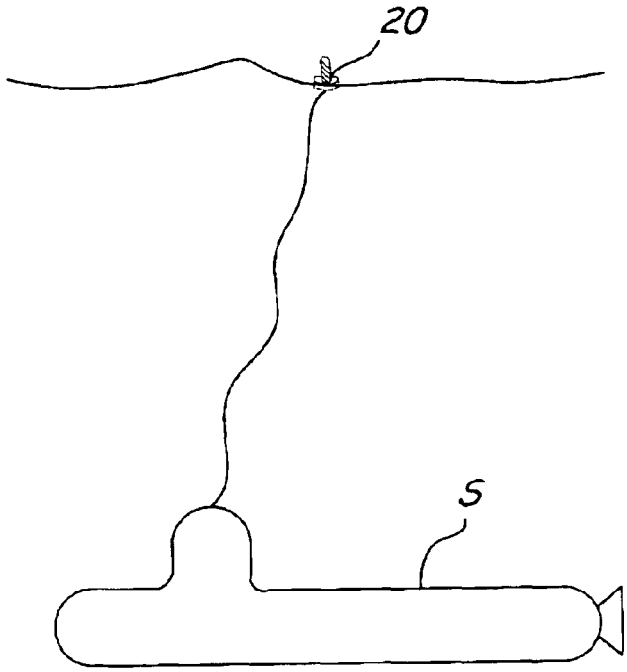
FIG. 12 is a side elevational view of the inflatable antenna according to still another embodiment of the invention.

As shown in FIG. 11, the invention may even be used with an underwater communications device or satellite-based location device 72 where it is desired to remain submerged while engaging in electronic communications. In such a circumstance the antenna would be designed to be separate or detachable from the communications/location device and would float on the surface 74 of the water, while being connected to the communications device via a waterproof electrical connection such as a cable 76. The antenna may be attached to a flotation device, or alternately, the production of gas from the ignited propellant inside the inflatable antenna could be used to increase the buoyancy of the antenna and urge the antenna to the surface of the water. A diver so using the invention could remain submerged, while the relatively small, unobtrusive antenna floats on the surface of the water. Alternatively, antenna 20 may be operatively connected to communication equipment on a submarine S (FIG. 12) and may therefore permit the submarine to conduct sensing, jamming, and/or transceiving missions while remaining submerged. The temporary nature of the inflatable antenna can be used to great advantage in underwater operations because as gas eventually leaks out of antenna 20, the buoyancy of the antenna decreases and the antenna sinks into the water, thereby removing evidence of electronic surveillance or communication.

An advantage of the inflatable antenna of the invention is that it may be used with electronic attack/electronic warfare operations in scenarios where high portability and secrecy are paramount. The antenna may be rapidly deployed to reduce mission/personnel risk and may be remotely inflated.

Another advantage is that by cutting the antenna elements from conductive foil and adhering the antenna elements to the first flexible sheet, a resonant antenna circuit can be obtained without expensive and complex chemical etching processes.

Another advantage is that the inflatable antenna may be easily mass-produced with a minimum of steps, thereby providing an inexpensive and portable antenna.

Still another advantage is that the inflatable antenna may be used to facilitate electronic communications to and from an underwater communications source, such as a submarine or an underwater diver.

Yet another advantage is that the antenna is rugged and can survive, in its non-inflated state, extreme acceleration and vibrations.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A terrestrially deployed flexible antenna, comprising:

a flexible dielectric material having a first surface and a second surface;

a flexible conductive ground plane secured to the first surface of the dielectric material;

at least one flexible, planar conductive element secured to the second surface of the flexible dielectric material, wherein the flexible dielectric material is bonded to form a collapsible enclosed volume with the ground plane forming an inner surface of the enclosed volume;

a propellant disposed within the enclosed volume, wherein the propellant releases a predetermined volume of gas when ignited; and an igniter configured to ignite the propellant to release the predetermined volume of gas, to thereby temporarily expand the enclosed volume to a predetermined shape such that the ground plane, the dielectric material, and the at least one conductive element cooperate to form a resonant antenna circuit.

2. The flexible antenna of claim 1, wherein the propellant is sodium azide.

3. The flexible antenna of claim 1, wherein the propellant is one of nitroguanidine, tri-amino guanidine nitrate, guanidinium azotetrazolate, and 5-amino-tetrazole.

4. The flexible antenna of claim 1, wherein the predetermined shape is substantially conical.

5. The flexible antenna of claim 4, wherein the at least one conductive element is arranged to form a conical helix antenna.

6. The flexible antenna of claim 1, wherein the predetermined shape includes a frustoconical shape defining an outer surface of the antenna, wherein the second surface of the flexible dielectric material is a portion of the outer surface, and a substantially concentric conical shape disposed within the frustoconical shape and defining an inner surface of the antenna, wherein the first surface of the flexible dielectric material is a portion of the inner surface.

7. The flexible antenna of claim 1, wherein the predetermined shape is substantially cylindrical.

8. The flexible antenna of claim 1, wherein the predetermined shape includes a substantially prismatic shape having an inner surface, wherein the first surface of the flexible dielectric material is a portion of the inner surface of the substantially prismatic shape; and further wherein the second surface of the flexible dielectric material extends between non-adjacent inner vertices of the substantially prismatic shape.

9. A remote communications device, comprising:

a transceiver; and an expandable, terrestrially-based antenna operationally connected to the transceiver, wherein the antenna includes a sheet of flexible dielectric material having a first side and a second side, a flexible conductive ground plane secured to the first side of the flexible dielectric material, at least one flexible, planar conductive element secured to the second side of the flexible dielectric material, wherein the flexible dielectric material is shaped and bonded to form a collapsible enclosed volume with the ground plane forming an inner surface of the enclosed volume, a propellant enclosed within the enclosed volume, the propellant configured to release a gas when ignited, and an igniter configured to ignite the propellant and temporarily expand the enclosed volume to a predetermined shape such that the ground plane, the dielectric material, and the at least one conductive element cooperate to form a resonant electrical circuit.

10. The remote communications device of claim 9, wherein the transceiver and expandable antenna are waterproof.

11. The remote communications device of claim 9, further comprising a waterproof electrical connection that connects the transceiver and the expandable antenna, and wherein the transceiver and expandable antenna are configured to operate separately such that the transceiver is operable in a submerged state and the expandable antenna is operable in a non-submerged state.

12. The remote communications device of claim 9, wherein the transceiver is an electronic warfare apparatus.

13. The remote communications device of claim 9, wherein the sheet of flexible dielectric material is one of TEFLON and KAPTON.

14. The remote communications device of claim 9, wherein the expandable antenna is camouflaged to reduce visibility of the antenna in an environment in which the antenna is to be deployed.

15. A method of establishing electronic communication in an electronic warfare environment, comprising:

connecting an electronic communications apparatus to a temporarily expandable terrestrial antenna, the antenna including a substantially enclosed volume with one or more antenna elements secured thereon and a propellant disposed therein, the propellant configured to release a gas when ignited;

igniting the propellant and thereby releasing gas in the substantially enclosed volume, wherein the substantially enclosed volume is temporarily expanded to assume a predetermined shape, wherein the antenna elements are connected to the electronic communications apparatus.

16. The method of claim 15, further comprising:

forming the temporarily expandable antenna from a flexible, planar dielectric material attached to a conductive ground plane, wherein the one or more antenna elements are secured to the dielectric material.

17. The method of claim 15, further comprising:

determining an environment in which the expandable antenna is to be deployed; and camouflaging the expandable antenna to reduce noticability of the expandable antenna within the environment.

18. The method of claim 15, wherein the predetermined shape is one of cylindrical, conical, and parabolic.

* * * * *